US011846914B2

(12) United States Patent
Hoshino et al.

(10) Patent No.: US 11,846,914 B2
(45) Date of Patent: Dec. 19, 2023

(54) WATCH

(71) Applicant: Seiko Epson Corporation, Tokyo (JP)

(72) Inventors: Kazunori Hoshino, Matsumoto (JP); Yuji Kiyosawa, Shiojiri (JP)

(73) Assignee: SEIKO EPSON CORPORATION

( * ) Notice: Subject to any disclaimer, the term of this patent is extended or adjusted under 35 U.S.C. 154(b) by 285 days.

(21) Appl. No.: 17/370,021

(22) Filed: Jul. 8, 2021

(65) Prior Publication Data

US 2022/0011723 A1 Jan. 13, 2022

(30) Foreign Application Priority Data

Jul. 9, 2020 (JP) ..... 2020-118308

(51) Int. Cl.
*G04B 47/04* (2006.01)
*A44C 17/02* (2006.01)
*G04B 37/00* (2006.01)

(52) U.S. Cl.
CPC ..... *G04B 47/042* (2013.01); *A44C 17/02* (2013.01); *G04B 37/0008* (2013.01)

(58) Field of Classification Search
CPC ..... G04B 45/0076; G04B 47/042; G04B 37/0008; G04B 39/002; A44C 17/04; A44C 17/02
USPC ..... 63/26–28
See application file for complete search history.

(56) References Cited

U.S. PATENT DOCUMENTS 1,941,782 A * 1/1934 Bager ..... A44C 17/02 63/26
5,119,350 A * 6/1992 Delacretaz ..... A44C 17/0258 368/322
6,491,424 B1 * 12/2002 Tardy ..... G04B 39/00 368/283
8,974,113 B1 * 3/2015 Chan ..... A44C 17/0208 368/285
11,096,457 B2 * 8/2021 Dholakiya ..... A44C 17/04
11,147,348 B2 * 10/2021 Lauper ..... G04B 45/0015

FOREIGN PATENT DOCUMENTS

JP 2005-323735 A 11/2005

* cited by examiner

*Primary Examiner* — Edwin A. Leon
(74) *Attorney, Agent, or Firm* — Harness, Dickey & Pierce, P.L.C.

(57) ABSTRACT

A watch is a watch including a watch case, a cover glass attached to the watch case, and a decorative body attached to the watch case, wherein the watch case includes a holding wall portion provided along an outer periphery of the cover glass, a first column portion provided outside the holding wall portion, a second column portion provided outside the holding wall portion, and provided at a distance from the first column portion, and an inclined portion including an inner end portion formed from between the first and second column portions to the holding wall portion, and is connected with the holding wall portion, and an outer end portion is connected with an outer surface of the watch case and provided at a position close to a rear surface of the watch case, and the decorative body is held by the holding wall portion, the first, and second column portions.

4 Claims, 14 Drawing Sheets

WATCH

The present application is based on, and claims priority from JP Application Serial Number 2020-118308, filed Jul. 9, 2020, the disclosure of which is hereby incorporated by reference herein in its entirety.

BACKGROUND

1. Technical Field

The present disclosure relates to a watch to which decorative bodies such as precious stones are attached.

2. Related Art

As a watch, one that is obtained by attaching precious stones as decorative bodies to a surface of a watch case, improving design, and increasing a value as an accessory has been known (see, for example, JP 2005-323735 A).

In JP 2005-323735 A, a plurality of receiving recesses for receiving decorative bodies in the surface of the watch case are formed, a center groove, a side groove, and a transverse groove are machined in the receiving recess to form a holding finger, and the holding finger is bent toward the decorative body received in the receiving recess to hold the decorative body.

In the holding structure of JP 2005-323735 A, a lower portion of the decorative body is held in the receiving recess, so a direction in which light is incident on the decorative body is limited to only above, and it is difficult to sufficiently bring out beauty of the decorative body.

SUMMARY

A watch of the present disclosure is a watch including a watch case, a cover glass attached to the watch case, and a decorative body attached to the watch case, wherein the watch case includes a holding wall portion provided along an outer periphery of the cover glass, a first column portion provided outside the holding wall portion, a second column portion provided outside the holding wall portion, and provided at a distance from the first column portion, and an inclined portion including an inner end portion formed from between the first column portion and the second column portion to the holding wall portion, and is connected with the holding wall portion, and an outer end portion is connected with an outer surface of the watch case and provided at a position close to a rear surface of the watch case, and the decorative body is held by the holding wall portion, the first column portion, and the second column portion.

DESCRIPTION OF EXEMPLARY EMBODIMENTS

First Exemplary Embodiment

A watch 1 of a first exemplary embodiment of the present disclosure will be described below based on FIG. 1 to FIG. 4.

Figure 2:
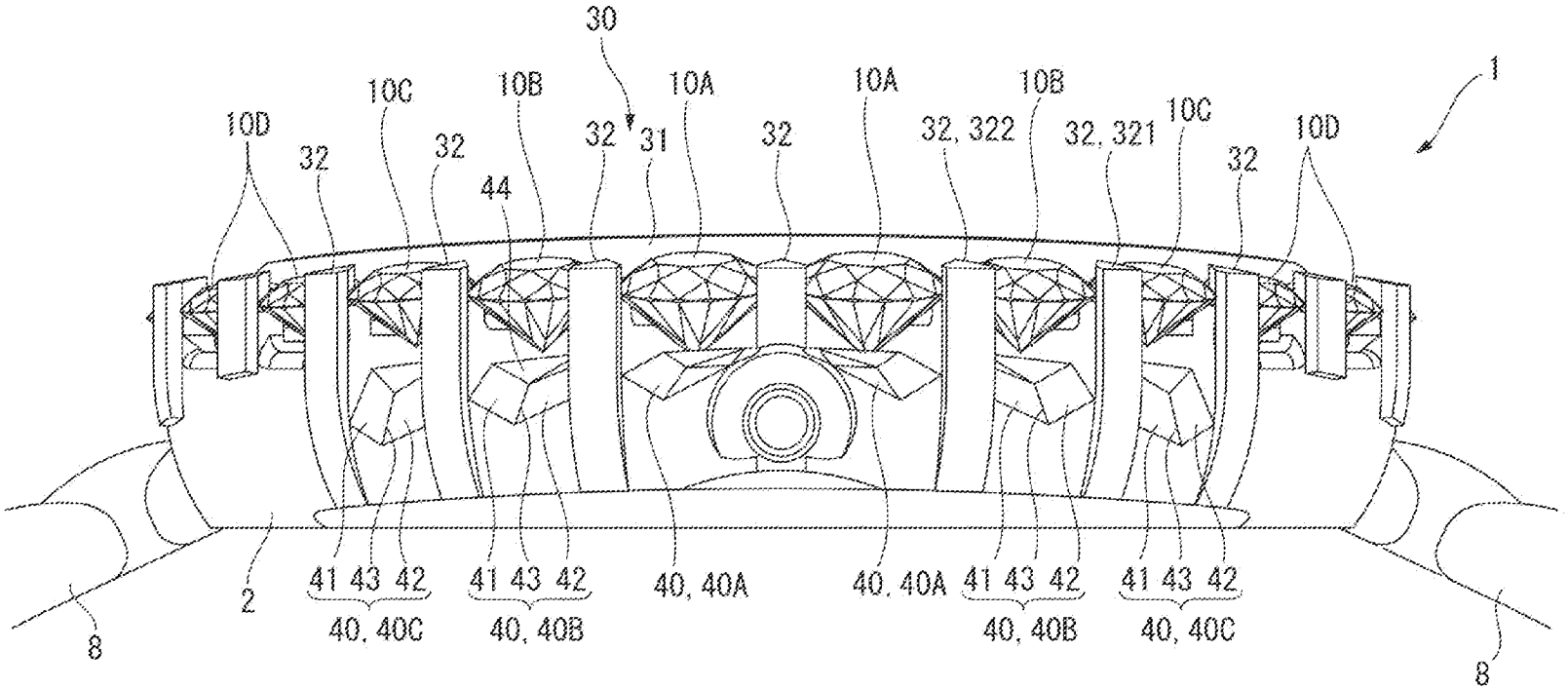
FIG. 2 is a side view illustrating the watch of the first exemplary embodiment.
Figure 3:
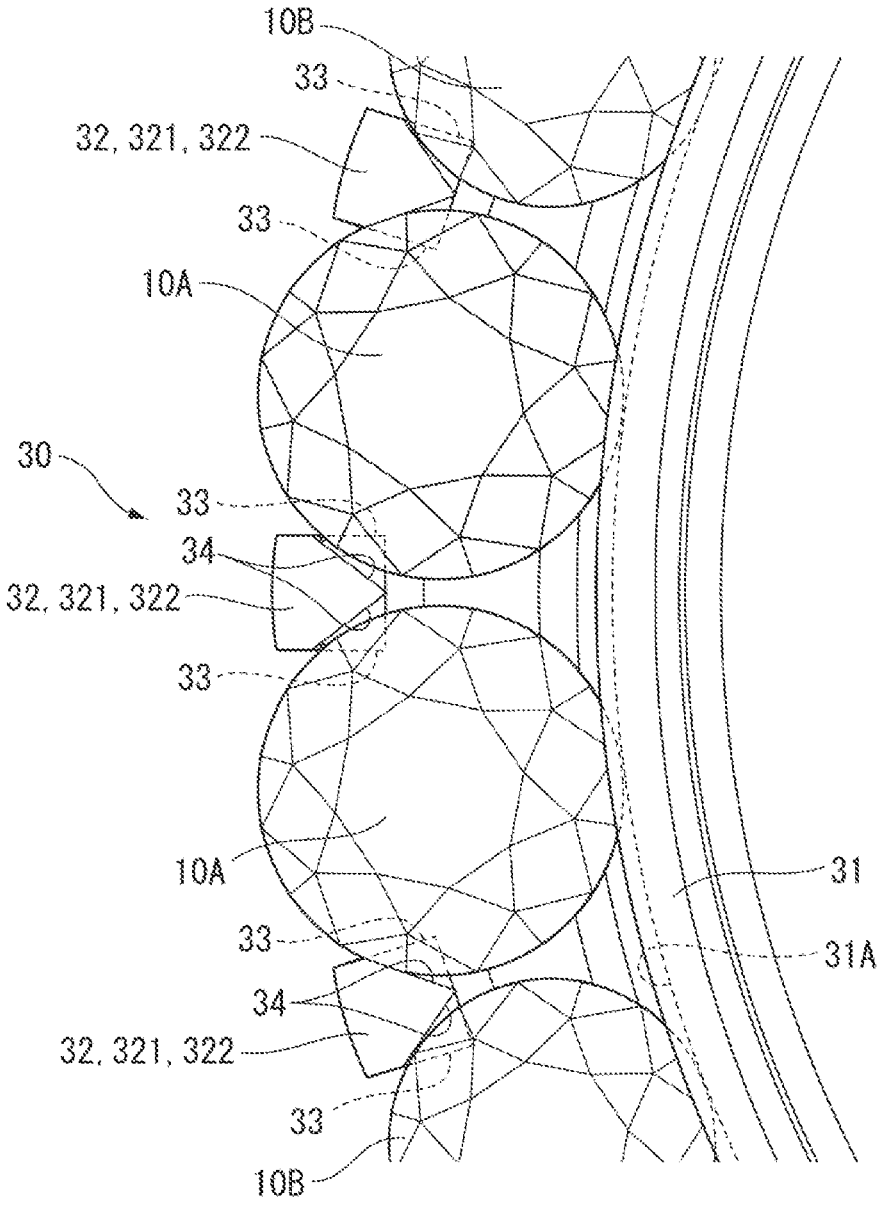
FIG. 3 is an enlarged view illustrating a main portion of the watch of the first exemplary embodiment.
Figure 4:
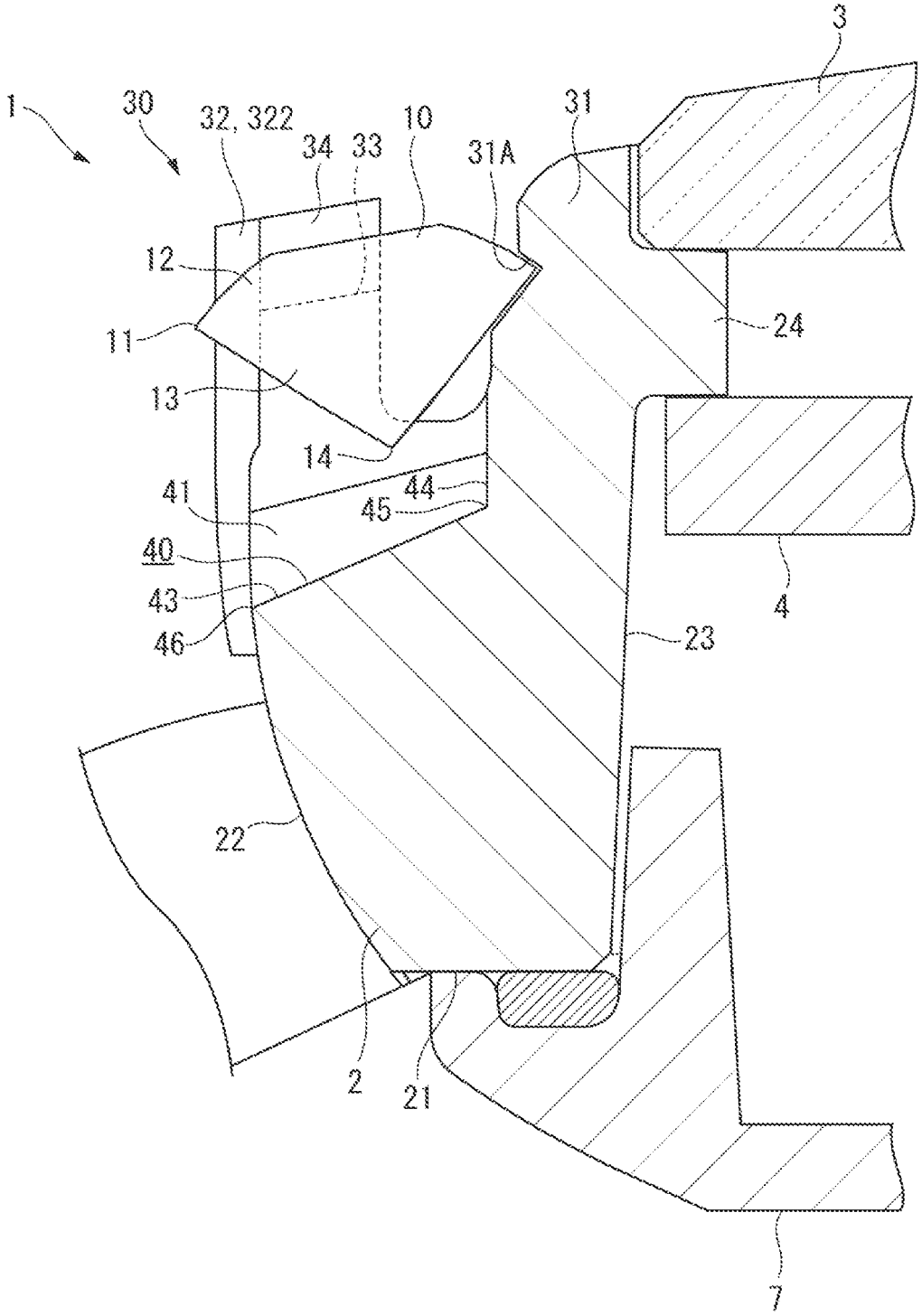
FIG. 4 is a cross-sectional view illustrating a main portion of the watch of the first exemplary embodiment.

As illustrated in FIG. 1 to FIG. 4, the watch 1 is a wristwatch worn on a wrist of a user, and includes a watch case 2, a cover glass 3 fitted in an upper surface of the watch case 2, a dial 4 provided below the cover glass 3, a hand 5 disposed between the cover glass 3 and the dial 4 to indicate a time, and a crown 6. The hand 5 is attached to a rotational movement shaft 5A. As illustrated in FIG. 4, a case back 7 is attached to a rear surface 21 of the watch case 2, and a movement (not illustrated) that drives the hand 5 is provided between the dial 4 and the case back 7. Note that, the watch 1 of the present exemplary embodiment is illustrated as the hand-type watch, but is not limited thereto, and may be a watch digitally displaying a time.

On an outer surface 22 of the watch case 2, a strap 8 is attached in a 12 o'clock direction and a 6 o'clock direction of the dial 4.

The watch case 2 is made from metal, alloy, or relatively hard metal or alloy such as stainless steel or titanium, and an outer shape thereof is integrally formed by pressing or the like.

As illustrated in FIG. 4, a protrusion portion 24 continuous over an entire circumference is formed at an inner surface 23 of the watch case 2. The cover glass 3 is locked on an upper surface of the protrusion portion 24, and the dial 4 is locked on a lower surface of the protrusion portion 24.

Decorative bodies 10 are attached to the upper surface of the watch case 2 so as to be arranged at substantially constant intervals. The decorative body 10 of the present exemplary embodiment is diamond, but is not limited to diamond as a decorative body, and may be other precious stones such as ruby, or may be glass other than precious stones or the like.

Figure 1:
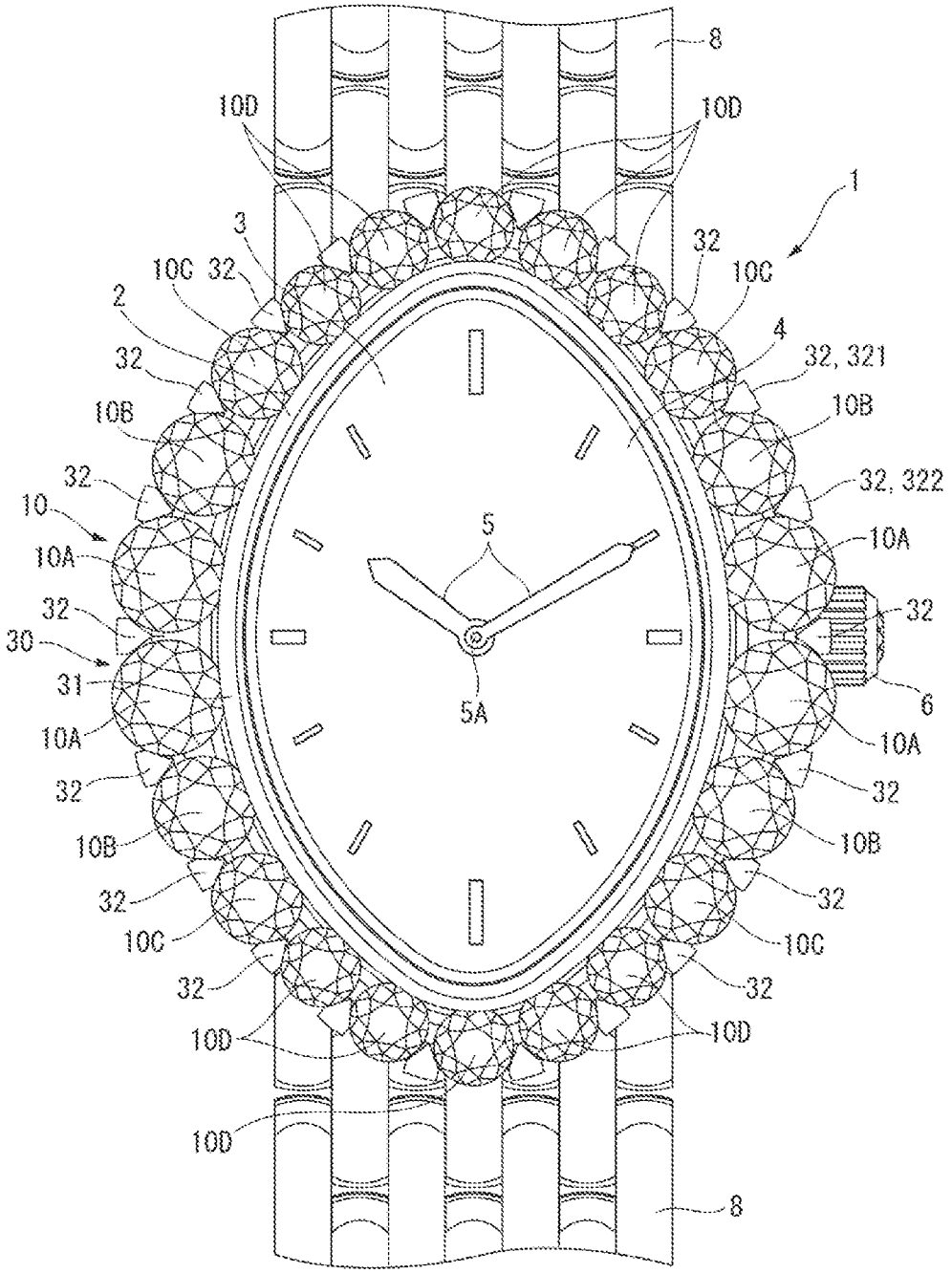
FIG. 1 is a plan view illustrating a watch of a first exemplary embodiment.

In the watch 1 of the present exemplary embodiment, as illustrated in FIG. 1, two decorative bodies 10A each having a largest size are attached outside a 3 o'clock position and a 9 o'clock position of the dial 4, respectively, decorative bodies 10B each having a size smaller than that of the decorative body 10A are attached outside 2 o'clock, 4 o'clock, 8 o'clock, and 10 o'clock positions, respectively, and decorative bodies 10C each having a size smaller than that of the decorative body 10B are attached outside 1 o'clock, 5 o'clock, 7 o'clock, and 11 o'clock positions, respectively. Furthermore, five decorative bodies 10D each having a size smaller than that of the decorative body 10C are attached between the decorative bodies 10C outside a 12 o'clock position and a 6 o'clock position of the dial 4, respectively. Here, "attached outside" refers to an aspect of being disposed at a position far from a center of the watch 1.

Hereinafter, mounting structure of the decorative body 10 to the watch case 2 will be described in detail.

The watch case 2 includes an attachment portion 30 to which the plurality of decorative bodies 10 provided along an outer periphery of the cover glass 3 are attached.

The attachment portion 30 includes a holding wall portion 31 provided continuously around the outer periphery of the cover glass 3, and a plurality of column portions 32 provided outside the holding wall portion 31. The respective column portions 32 are provided at intervals in an outer peripheral direction of the cover glass 3. Then, one decorative body 10 is held by the holding wall portion 31 and the two column portions 32.

Here, in the present exemplary embodiment, one of the two column portions 32 holding one decorative body 10 is a first column portion 321, and another is a second column portion 322. Therefore, the column portion 32 between the two decorative bodies 10 is the first column portion 321 with respect to one decorative body 10, and is the second column portion 322 with respect to another decorative body 10. Specifically, in plan view of the watch 1, the column portion 32 on a counterclockwise side with respect to the decorative body 10 is set as the first column portion 321, and the column portion 32 on a clockwise side is set as the second column portion 322.

For example, in FIG. 1 and FIG. 2, of the column portions 32 that hold the decorative body 10B at the 2 o'clock position, the column portion 32 between the decorative body 10B and the decorative body 10C on a 1 o'clock side is the first column portion 321, and the column portion 32 between the decorative body 10B and the decorative body 10A on a 3 o'clock side is the second column portion 322.

Further, of the column portions 32 that hold the decorative body 10C at the 1 o'clock position, the column portion 32 between the decorative body 10C and the decorative body 10D on a 12 o'clock side is the first column portion 321, and the column portion 32 between the decorative body 10C and the decorative body 10B on a 2 o'clock side is the second column portion 322.

As illustrated in FIG. 4, a holding groove 31A in which an outer peripheral portion of the decorative body 10 is held is formed at an outer peripheral surface of the holding wall portion 31. Note that, the decorative body 10 of the present exemplary embodiment is a round brilliant cut diamond, and includes an outer peripheral portion 11 referred to as a girdle, an upper side portion 12 referred to as a crown on an upper side of the girdle, and a lower side portion 13 referred to as a pavilion on a lower side of the girdle. On the lower side portion 13, a lower end portion 14 at which cut surfaces of the pavilion gather is referred to as a culet.

As illustrated in FIG. 3 and FIG. 4, two mounting surfaces 33 on each of which the outer peripheral portion of the decorative body 10 is mounted are formed at the column portion 32. In addition, two holding surfaces 34 each connected with the mounting surface 33 are formed at a side surface of the column portion 32, and these holding surfaces 34 are configured to be capable of contacting an outer periphery of the decorative body 10 to hold the decorative body 10.

Therefore, the decorative body 10 is held by the holding groove 31A of the holding wall portion 31, the mounting surface 33 and the holding surface 34 of the first column portion 321, and the mounting surface 33 and the holding surface 34 of the second column portion 322. In other words, the decorative body 10 is held by approximately three places on the outer periphery of the decorative body 10.

As illustrated in FIG. 2 and FIG. 4, an inclined portion 40 is formed at the watch case 2, that is connected with the first column portion 321 and the second column portion 322 that hold the decorative body 10A, 10B, or 10C to the holding wall portion 31.

As illustrated in FIG. 4, the inclined portion 40 is inclined so that an outer end portion 46, which is connected with the outer surface 22 of the watch case 2, is provided at a position closer to the rear surface 21 of the watch case 2 than an inner end portion 45, which is connected with the holding wall portion 31. In other words, in the watch case 2, when a direction from the case back 7 toward the cover glass 3 is defined as upward, and an opposite direction thereof is defined as downward, the inclined portion 40 is inclined downward facing from the inner end portion 45 toward the outer end portion 46. In other words, a distance from the inner end portion 45 to the decorative body 10 is shorter than a distance from the outer end portion 46 to the decorative body 10.

Furthermore, as illustrated in FIG. 2, the inclined portion 40 is formed to have a V-shape in side view when the watch case 2 is viewed from a side surface direction. As a result, the inclined portion 40 includes a left inclined surface portion 41 and a right inclined surface portion 42 provided sandwiching bottom 43 of a V-shaped groove. The left inclined surface portion 41 is provided on a left side of the bottom 43 in the side view, and the right inclined surface portion 42 is provided on a right side of the bottom 43 in the side view. An intersection angle of the left inclined surface portion 41 and the right inclined surface portion 42 is set to an obtuse angle, that is, to be 90 degrees or greater, and less than 180 degrees.

An end surface portion 44 that is connected with the holding wall portion 31 is provided between respective end portions of the left inclined surface portion 41 and the right inclined surface portion 42 on the holding wall portion 31 side.

As illustrated in FIG. 4, the end surface portion 44 is formed at a position of the inner end portion 45, that is, on an inner side of the watch than the lower end portion 14 of the decorative body 10. As a result, the inclined portion 40 is disposed below the lower end portion 14 of the decorative body 10.

Furthermore, a depth of an inclined surface, that is, an inclination angle of the inclined portion 40 differs depending on a location on the watch case 2. Specifically, when comparing inclined portions 40A, 40B, and 40C provided below the decorative bodies 10A, 10B, and 10C, respectively, the inclined portion 40B is set to have a greater depth and a greater inclination angle compared to the inclined portion 40A, and to have a less depth and a less inclination angle compared to the inclined portion 40C.

Additionally, the decorative body 10 is attached so as to be separated upward from the inclined portion 40, and is held floating from the inclined portion 40 by the holding wall portion 31, the first column portion 321, and the second column portion 322.

Advantageous Effects of First Exemplary Embodiment

The watch 1 supports the decorative body 10 with the first column portion 321, the second column portion 322, and the holding groove 31A of the holding wall portion 31, and includes the inclined portion 40 that is provided between the first column portion 321 and the second column portion 322 to the holding wall portion 31, and inclines downward facing toward an outside, and thus can cause light incident from between the first column portion 321 and the second column portion 322 on a side surface of the watch 1 to be reflected by the inclined portion 40 and incident from a lower side or lower side portion 13 of the decorative body 10. Therefore, compared to a case where light is incident only on the upper side portion 12 of the decorative body 10, glitter of the decorative body 10 is increased, and radiation directions of the light also spread out, so the decorative body 10 can be made to beautifully glitter. Therefore, a product value of the watch 1 to which the decorative body 10 is attached can be improved, and high-class feel can be increased.

The inclined portion 40 has a bottom surface having a V-shape, and the intersection angle of the left inclined surface portion 41 and the right inclined surface portion 42 is set to the obtuse angle that is, to be 90 degrees or greater, and less than 180 degrees, and thus light reflected by the left inclined surface portion 41 or the right inclined surface portion 42 can be incident more on the decorative body 10, and the glitter of the decorative body 10 can be further increased.

As illustrated in FIG. 2, because the inclined portion 40 is constituted by the inclined portions 40A, 40B, and 40C whose depths are different depending on the respective locations on the watch case 2, and the way light enters is not monotonous, such as an angle at which light reflected by the inclined portion 40A, 40B, or 40C is incident on the decorative body 10, so the decorative body 10 glitters in a complicated manner, and can be made to more beautifully glitter.

Additionally, because the decorative body 10 is attached away from the inclined portion 40, the inclined portion 40 does not need to have a shape suitable for holding the decorative body 10, and can be formed in a shape in consideration of light reflection, so light can be effectively reflected and incident on the decorative body 10.

Second Exemplary Embodiment

Figure 5:
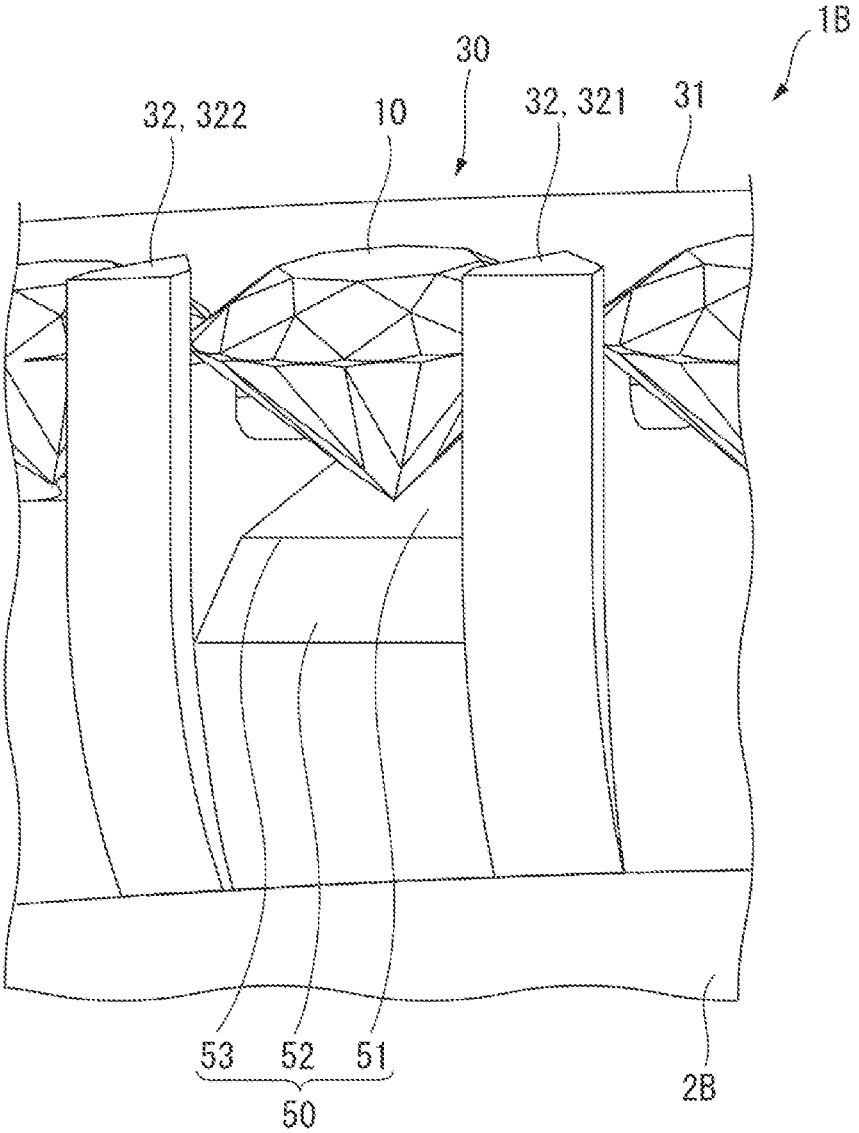
FIG. 5 is a perspective view illustrating a main portion of a watch of a second exemplary embodiment.
Figure 6:
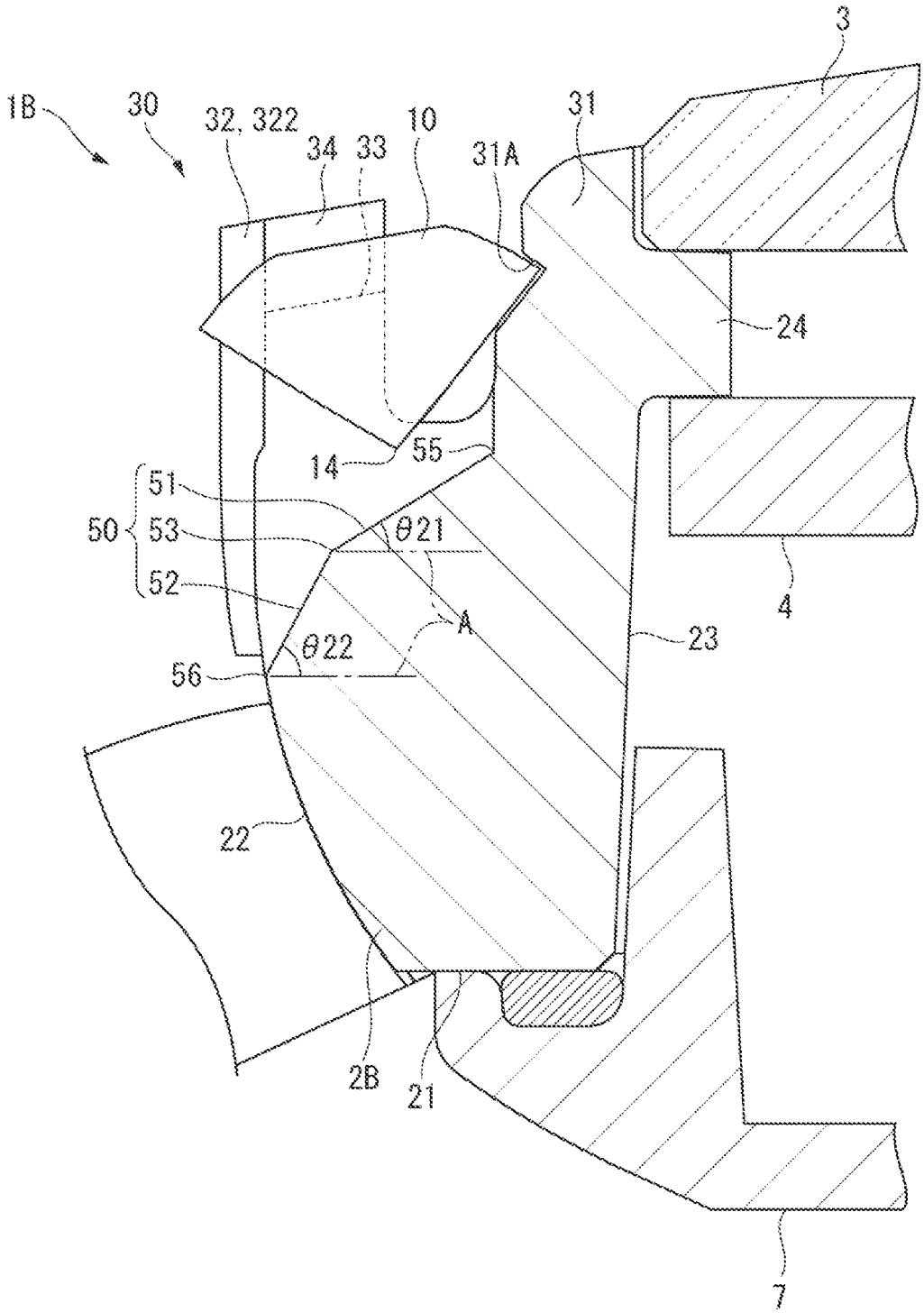
FIG. 6 is a cross-sectional view illustrating a main portion of the watch of the second exemplary embodiment.

A watch 1B of a second exemplary embodiment will be described based on FIG. 5 and FIG. 6. Note that, each exemplary embodiment following the second exemplary embodiment differs in a shape of an inclined portion, and the other configurations are the same, so only the inclined portion will be described.

An inclined portion 50 provided at a watch case 2B of the second exemplary embodiment includes a first inclined portion 51 having a first inclination angle θ21 and connected with the holding wall portion 31, and a second inclined portion 52 having a second inclination angle θ22 and continues with an outside the first inclined portion 51. The inclined portion 50 is inclined so that an outer end portion 56 is provided at a position closer to the rear surface 21 of the watch case 2B than an inner end portion 55. That is, the inclined portion 50 is inclined downward facing from the inner end portion 55 toward the outer end portion 56. The inclined portion 40 of the first exemplary embodiment has the V-shape in side view of the watch case 2, but the inclined portion 50 of the second exemplary embodiment is formed in a straight line to form a flat surface in side view of the watch case 2B.

The first inclination angle θ21 and the second inclination angle θ22 are inclination angles with respect to an imaginary plane A, and the first inclination angle θ21 is less than the second inclination angle θ22. Note that, the imaginary plane A is a surface orthogonal to an axis of a rotational movement shaft 5A of the hand 5. In other words, the imaginary plane A is a surface whose normal line is set to match the axis of the rotational movement shaft 5A.

Further, a connection portion 53, which is a joint between the first inclined portion 51 and the second inclined portion 52, is configured to be positioned outside the lower end portion 14 of the decorative body 10 in a direction from the inner surface 23 toward the outer surface 22 of the watch case 2B.

Furthermore, also in the second exemplary embodiment, a depth of the inclined portion 50, that is, an angle of the inclination angles θ21 and θ22 is set to be different depending on a position on the watch case 2B.

Advantageous Effects of Second Exemplary Embodiment

The watch 1B of the second exemplary embodiment also includes the inclined portion 50 provided between the first column portion 321 and the second column portion 322 and connected with the holding wall portion 31, and inclined downward facing outward, so light incident from between the respective column portions 321 and 322 can be reflected by the inclined portion 50 and incident from the lower side of the decorative body 10, glitter of the decorative body 10 is increased, and radiation directions of the light also spread out, so the decorative body 10 can be made to more beautifully glitter. Therefore, a product value of the watch 1B to which the decorative body 10 is attached can be improved, and high-class feel can be increased.

Since the inclined portion 50 includes the first inclined portion 51 and the second inclined portion 52 having the different inclination angles θ21 and θ22 respectively, light incident from different directions on a side of the watch case 2B can be reflected, and incident on the decorative body 10.

In particular, since the second inclination angle θ22 is greater than the first inclination angle θ21, for example, as compared to a case in which the inclination angle θ22 is less than θ21, an opening area between the first column portion 321 and the second column portion 322 can be increased, and more light can be incident on the decorative body 10.

Furthermore, the connection portion 53 of the first inclined portion 51 and the second inclined portion 52 is positioned outside the lower end portion 14 of the decorative body 10, light reflected by the first inclined portion 51 can be more easily incident not only on an inner cut surface but also on an outer cut surface than the lower end portion 14 in the lower side portion 13, and the decorative body 10 can be made to beautifully glitter.

Because the depth of the inclined portion 50 differs depending on a location on the watch case 2B, the decorative body 10 glitters in a complicated manner, and the decorative body 10 can be made to beautifully glitter.

Third Exemplary Embodiment

Figure 7:
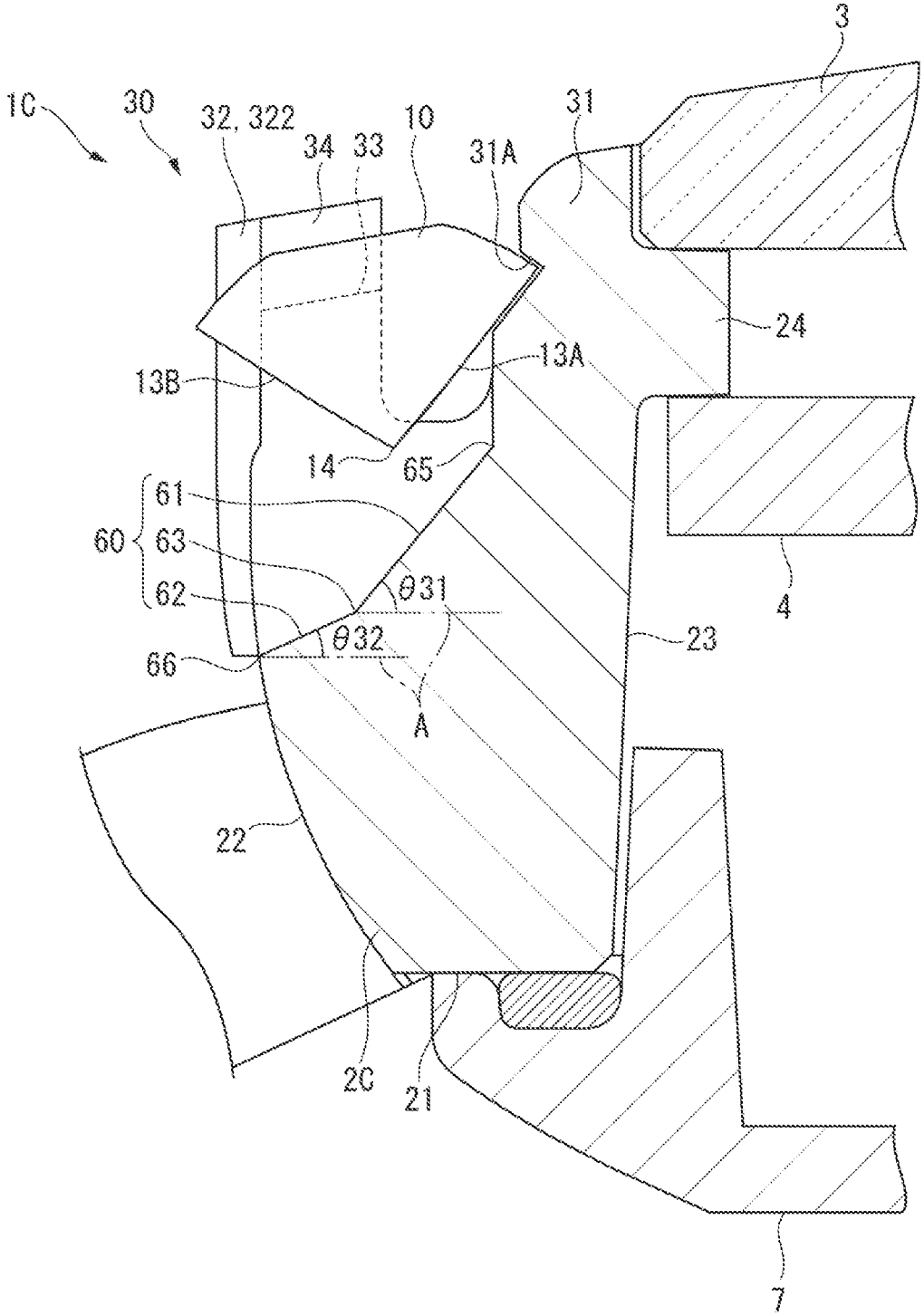
FIG. 7 is a cross-sectional view illustrating a main portion of a watch of a third exemplary embodiment.

An inclined portion 60 provided at a watch case 2C of a watch 1C of a third exemplary embodiment will be described based on FIG. 7.

The inclined portion 60 of the third exemplary embodiment is similar to the inclined portion 50 of the second exemplary embodiment in that a first inclined portion 61 and a second inclined portion 62 are included, and a connection portion 63 of the first inclined portion 61 and the second inclined portion 62 is disposed outside the lower end portion 14, but is different from the inclined portion 50 in that a first inclination angle θ31 of the first inclined portion 61 is greater than a second inclination angle θ32 of the second inclined portion 62.

Further, the first inclined portion 61 differs from the inclined portion 50 in that the first inclined portion 61 is provided in parallel with one cut surface 13A that is on an inner side of the lower end portion 14 in the lower side portion 13 of the decorative body 10.

The inclined portion 60 is inclined so that an outer end portion 66 is provided at a position closer to the rear surface 21 of the watch case 2C than an inner end portion 65. That is, the inclined portion 60 is inclined downward facing from the inner end portion 65 toward the outer end portion 66.

Such a third exemplary embodiment can achieve the same effects as the second exemplary embodiment.

In addition, because the first inclined portion 61 is parallel to the cut surface 13A, compared with the inclined portion 50 in which the first inclined portion 51 is not parallel to the cut surface 13A, light incident on the first inclined portion 61 at various angles easily enters the cut surface 13A, and the decorative body 10 can be made to more beautifully glitter. Furthermore, because the first inclined portion 61 is extended outward the lower end portion 14, light reflected by the first inclined portion 61 can be incident not only on the cut surface 13A but also on a cut surface 13B outside the lower end portion 14, and the decorative body 10 can be made to more beautifully glitter.

Fourth Exemplary Embodiment

Figure 8:
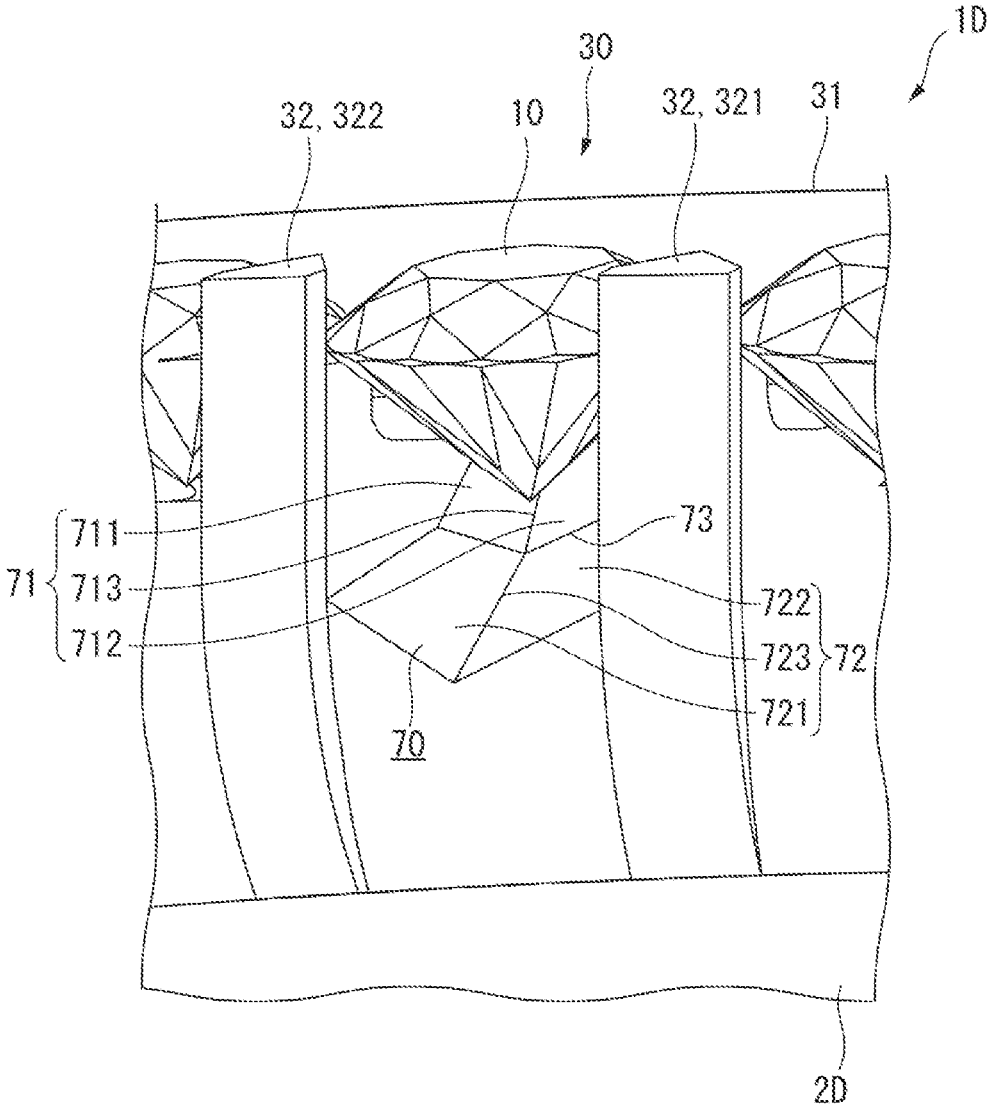
FIG. 8 is a perspective view illustrating a main portion of a watch of a fourth exemplary embodiment.

An inclined portion 70 provided at a watch case 2D of a watch 1D of a fourth exemplary embodiment will be described based on FIG. 8 and FIG. 9.

The inclined portion 70 of the fourth exemplary embodiment includes a first inclined portion 71 and a second inclined portion 72, and the first inclined portion 71 and the second inclined portion 72 are each formed in a V-shape in side view. As such, the first inclined portion 71 includes a left inclined surface portion 711 and a right inclined surface portion 712 disposed left and right respectively with a bottom 713 interposed therebetween in side view, and the second inclined portion 72 includes a left inclined surface portion 721 and a right inclined surface portion 722 disposed left and right respectively with a bottom 723 interposed therebetween.

The inclined portion 70 is inclined so that an outer end portion 76 is provided at a position closer to the rear surface 21 of the watch case 2D than an inner end portion 75. That is, the inclined portion 70 is inclined downward facing from the inner end portion 75 toward the outer end portion 76.

Figure 9:
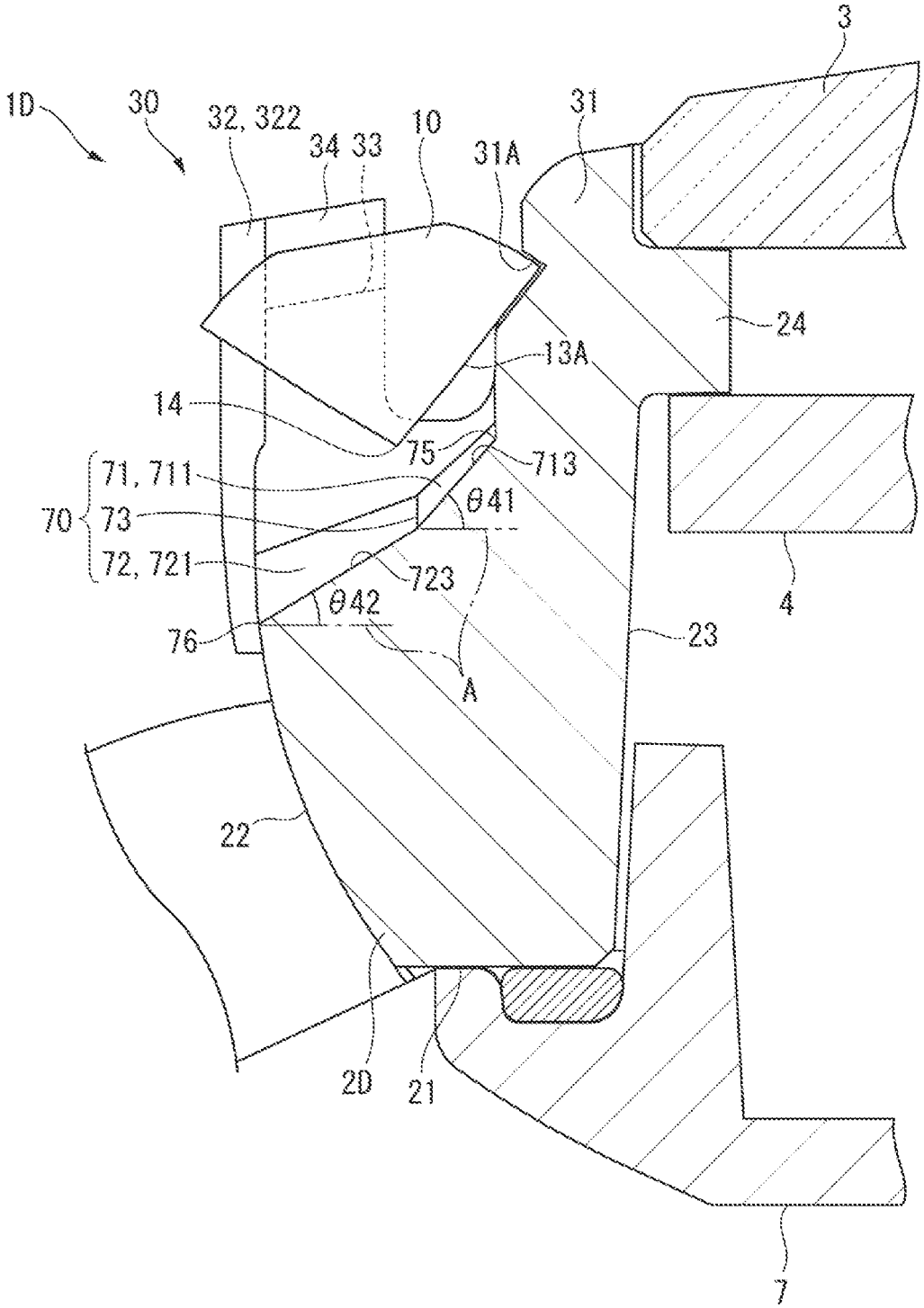
FIG. 9 is a cross-sectional view illustrating a main portion of the watch of the fourth exemplary embodiment.

As illustrated in FIG. 9, in the inclined portion 70, a position of a connection portion 73 in an in/out direction of the watch, which is a joint between the first inclined portion 71 and the second inclined portion 72, is set inside the lower end portion 14 of the decorative body 10.

Further, a first inclination angle θ41 with respect to the imaginary plane A of a bottom 713 of the first inclined portion 71 is greater than a second inclination angle θ42 with respect to the imaginary plane A of a bottom 723 of the second inclined portion 72. Furthermore, the bottom 713 of the first inclined portion 71 is provided substantially parallel to the cut surface 13A.

Such a fourth exemplary embodiment can achieve similar effects by a configuration similar to that of each exemplary embodiment described above.

In addition, because the connection portion 73 is set inside the lower end portion 14, and the second inclination angle θ42 is less than the first inclination angle θ41, a depth of an outer end edge of the second inclined portion 72 can be decreased, as compared to the inclined portion 50 and the inclined portion 60. For this reason, in the watch case 2D, the inclined portion 70 can be provided at a location where a depth dimension of an opening cannot be greatly increased between the column portions 321 and 322.

Fifth Exemplary Embodiment

Figure 10:
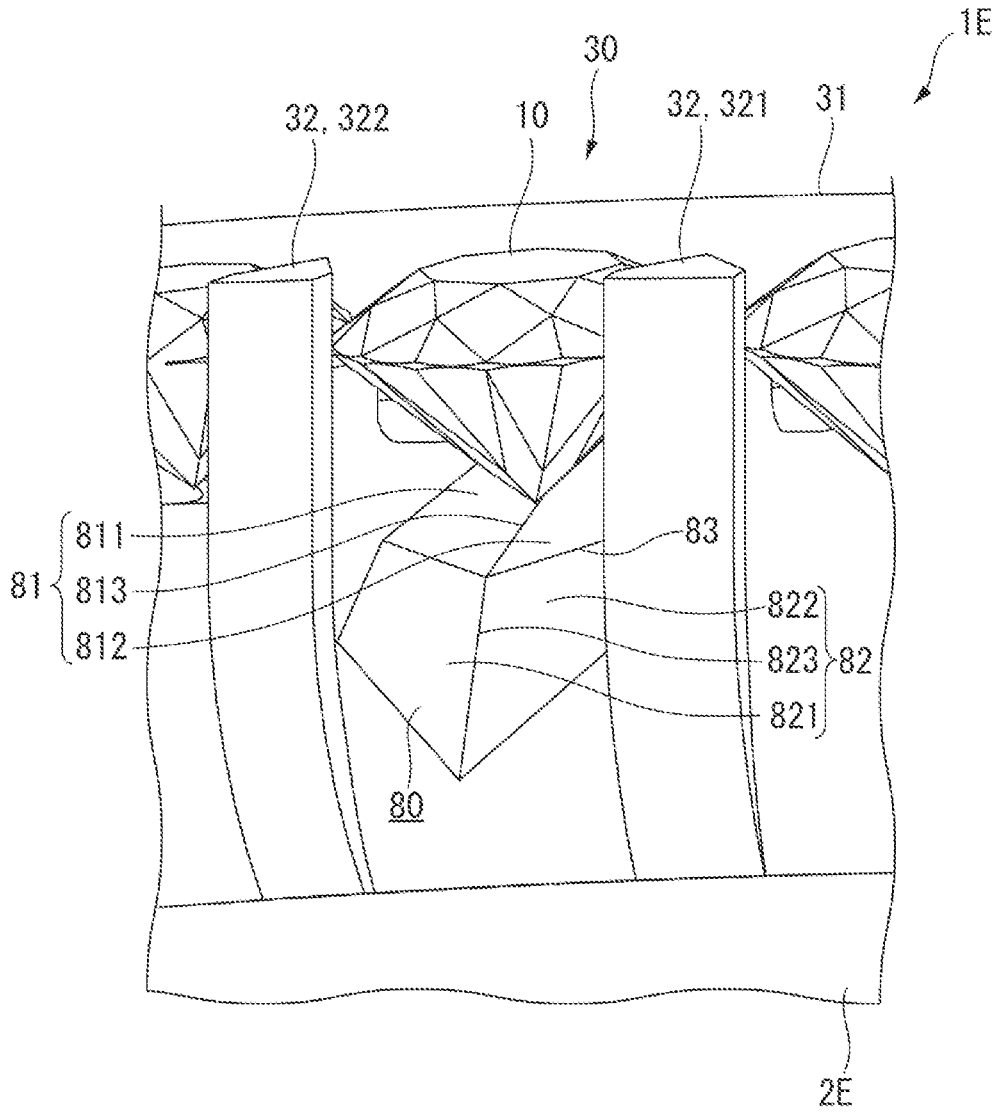
FIG. 10 is a perspective view illustrating a main portion of a watch of a fifth exemplary embodiment.

An inclined portion 80 provided at a watch case 2E of a watch 1E of a fifth exemplary embodiment will be described based on FIG. 10 and FIG. 11.

The inclined portion 80 of the fifth exemplary embodiment includes a first inclined portion 81 and a second inclined portion 82, and the first inclined portion 81 and the second inclined portion 82 are each formed in a V-shape in side view. As such, the first inclined portion 81 includes a left inclined surface portion 811 and a right inclined surface portion 812 disposed left and right respectively with a bottom 813 interposed therebetween in side view, and the second inclined portion 82 includes a left inclined surface portion 821 and a right inclined surface portion 822 disposed left and right respectively with a bottom 823 interposed therebetween.

The inclined portion 80 is inclined so that an outer end portion 86 is disposed at a position closer to the rear surface 21 of the watch case 2E than an inner end portion 85. That is, the inclined portion 80 is inclined downward facing from the inner end portion 85 toward the outer end portion 86.

In the inclined portion 80, a position of a connection portion 83 in an in/out direction of the watch, which is a joint between the first inclined portion 81 and the second inclined portion 82, is set inside the lower end portion 14 of the decorative body 10.

Figure 11:
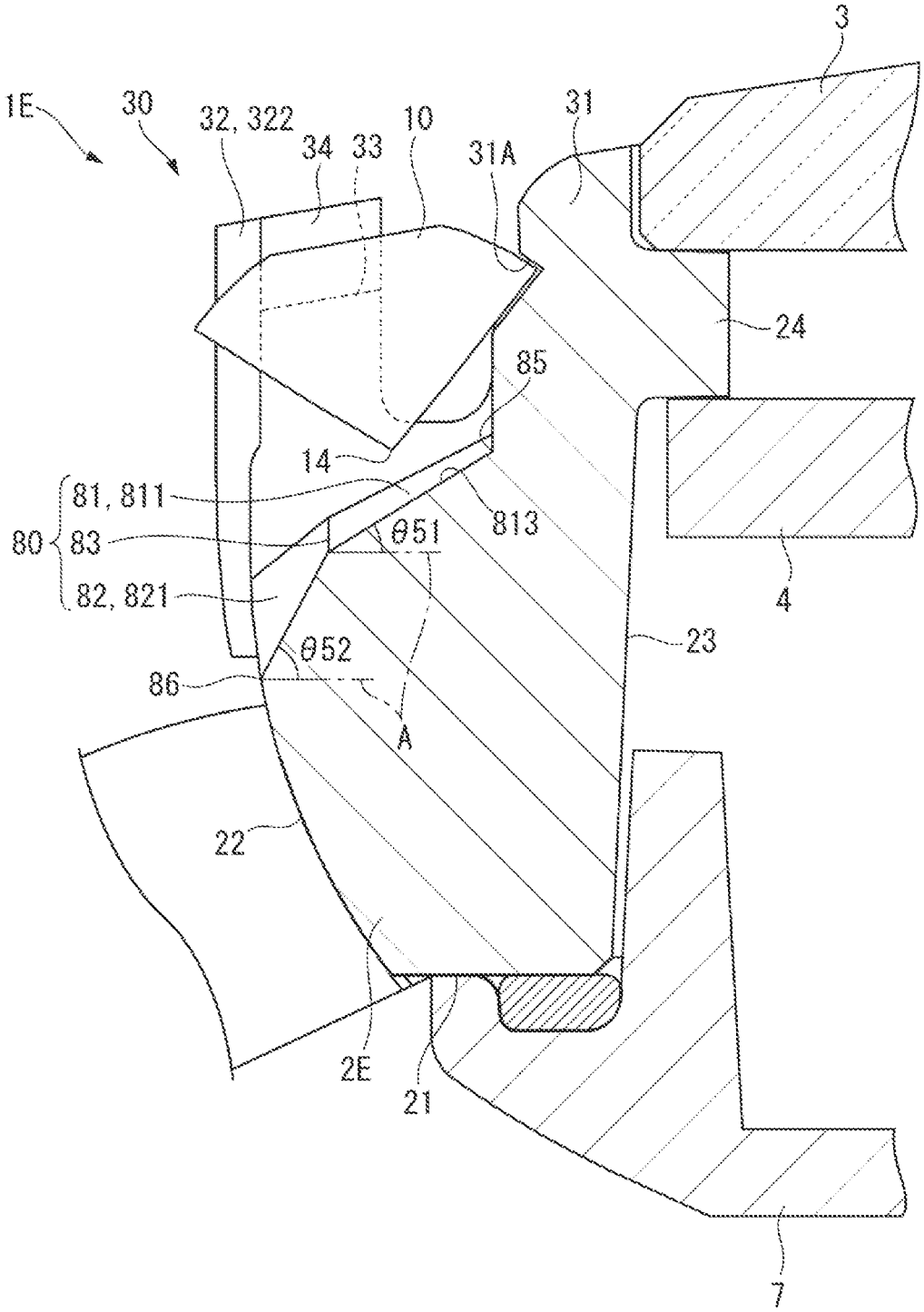
FIG. 11 is a cross-sectional view illustrating a main portion of the watch of the fifth exemplary embodiment.

Additionally, as illustrated in FIG. 11, a first inclination angle θ51 with respect to the imaginary plane A of the first inclined portion 81 is less than a second inclination angle θ52 with respect to the imaginary plane A of the second inclined portion 82.

Such a fifth exemplary embodiment can achieve similar effects by a configuration similar to that of each exemplary embodiment described above.

Sixth Exemplary Embodiment

Figure 12:
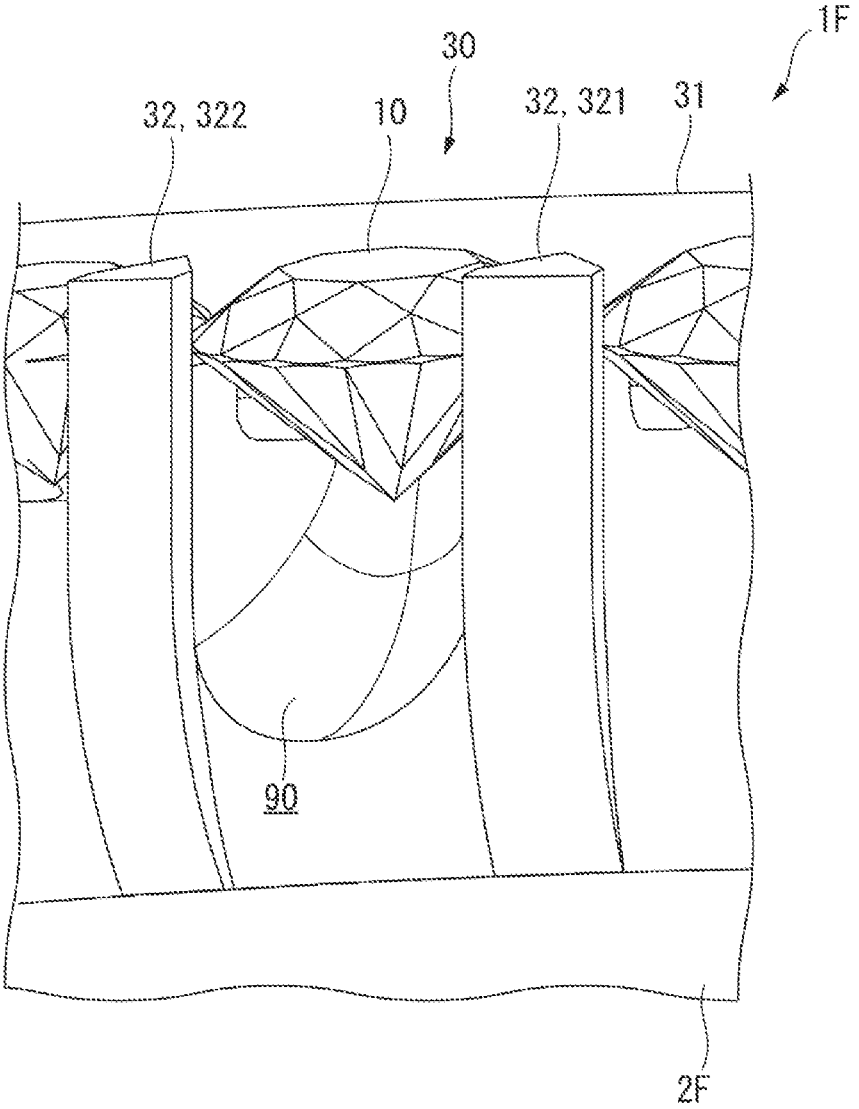
FIG. 12 is a perspective view illustrating a main portion of a watch of a sixth exemplary embodiment.
Figure 13:
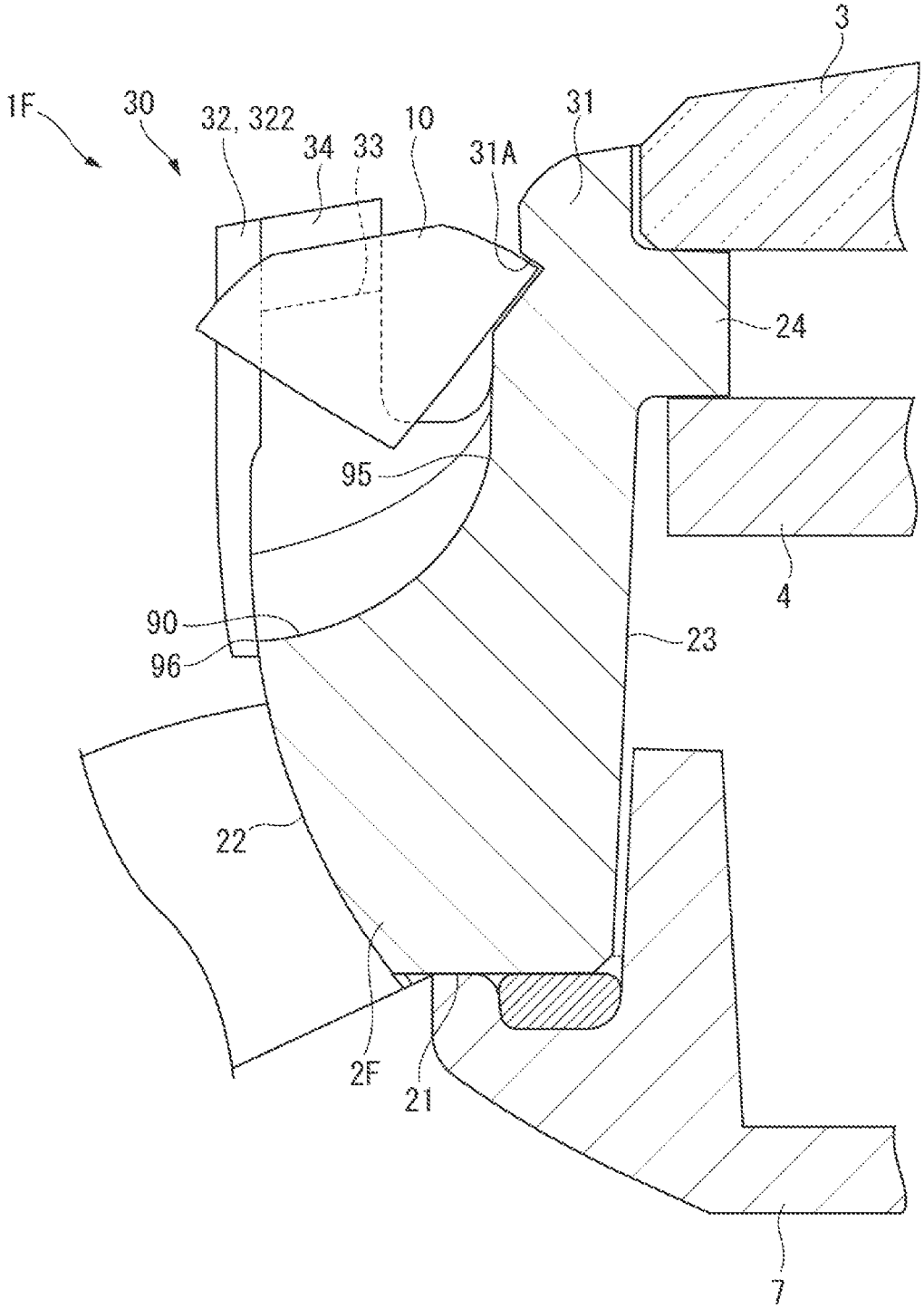
FIG. 13 is a cross-sectional view illustrating a main portion of the watch of the sixth exemplary embodiment.

An inclined portion 90 provided on a watch case 2F of a watch 1F of a sixth exemplary embodiment will be described based on FIG. 12 and FIG. 13.

The inclined portion 90 of the sixth exemplary embodiment is constituted by a curved surface inclined downward facing outward. The inclined portion 90 is set so that an inclination angle with respect to the imaginary plane A gradually decreases facing outward. In addition, the inclined portion 90 is also curved in a U-shape in side view. As a result, the inclined portion 90 has a shape like a concave mirror.

The inclined portion 90 is inclined so that an outer end portion 96 is disposed at a position closer to the rear surface 21 of the watch case 2F than an inner end portion 95. That is, the inclined portion 90 is inclined downward facing from the inner end portion 95 toward the outer end portion 96.

Such a sixth exemplary embodiment can achieve similar effects by a configuration similar to that of each exemplary embodiment described above.

Furthermore, because the inclined portion 90 is configured like a concave mirror, light reflected by the inclined portion 90 can be incident on the lower side portion 13 of the decorative body 10 from various directions, and the decorative body 10 can be made to more beautifully glitter.

Other Exemplary Embodiments

Note that the present disclosure is not limited to each of the exemplary embodiments described above, and variations, modifications, and the like within the scope in which the object of the present disclosure can be achieved are included in the present disclosure.

Figure 14:
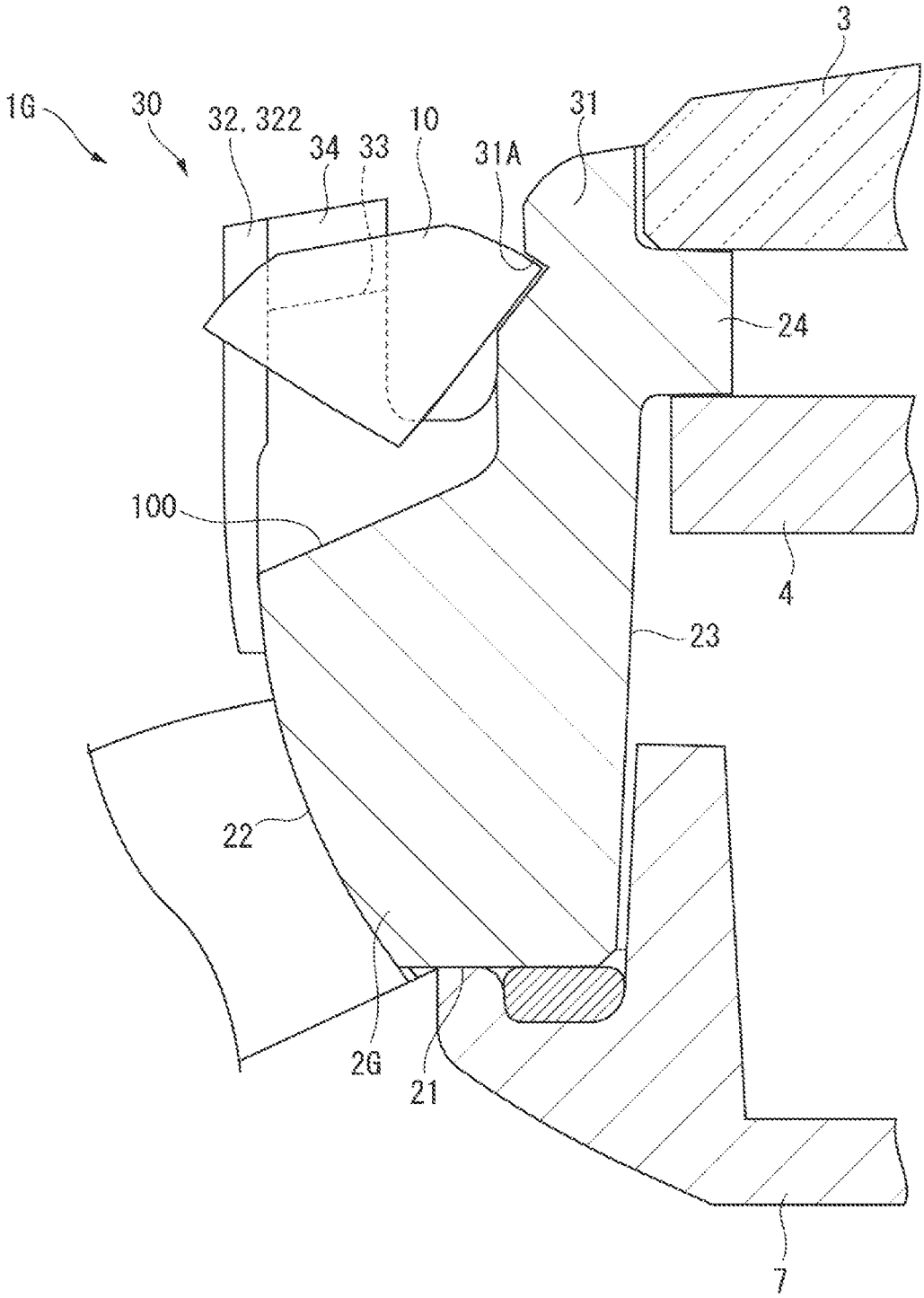
FIG. 14 is a cross-sectional view illustrating a main portion of a watch of a modified example.

For example, the inclined portion 40 of the first exemplary embodiment is formed in the V-shape in side view, but may be formed in a straight flat surface or straight line in side view, as an inclined portion 100 provided at a watch case 2G of a watch 1G illustrated in FIG. 14, or may be formed in a U-shape in side view.

Further, in the inclined portion 60 of the third exemplary embodiment, the first inclined portion 61 and the second inclined portion 62 are each constituted by the flat surface, but the first inclined portion 61 may be constituted by a flat surface, and the second inclined portion 62 may be constituted by a curved surface. Further, conversely, the first inclined portion 61 may be constituted by a curved surface, and the second inclined portion 62 may be formed from a flat surface.

Furthermore, the inclined portion 90 of the sixth exemplary embodiment is formed in the U-shape in side view, but may be provided with an inclined portion that does not curve in side view, but curves in only an in/out direction of the watch case 2. At this time, the inclined portion may be formed in a concave shape, or may be formed in a convex shape.

As the inclined portion, three or more inclined portions may be provided facing from an inner end portion toward an outer end portion. Additionally, when two or more inclined portions are provided, at least one inclined portion may be a surface parallel to the imaginary plane A. In other words, it is sufficient that the inclined portion is inclined so that an outer end portion is provided at a position closer to a rear surface of a watch case than an inner end portion.

The decorative body 10 is not limited to diamond, and may be other precious stones such as ruby, or may be glass or the like. Additionally, when a bottom surface of the decorative body 10 is curved, an inclined portion may also be a curved surface.

In the exemplary embodiment described above, the decorative bodies 10 are attached over the entire circumference along the outer periphery of the dial 4, but the number of decorative bodies attached to the watch may be one or more, and the number thereof is not limited.

Summary of Present Disclosure

A watch of the present disclosure is a watch including a watch case, a cover glass attached to the watch case, and a decorative body attached to the watch case, wherein the watch case includes a holding wall portion provided along an outer periphery of the cover glass, a first column portion provided outside the holding wall portion, a second column portion provided outside the holding wall portion, and provided at a distance from the first column portion, and an inclined portion including an inner end portion formed from between the first column portion and the second column portion to the holding wall portion, and connected with the holding wall portion, and an outer end portion connected with an outer surface of the watch case and provided at a position close to a rear surface of the watch case, and the decorative body is held by the holding wall portion, the first column portion, and the second column portion.

According to the watch of the present disclosure, light incident from between the first column portion and the second column portion on a side surface of the watch can be reflected by the inclined portion and incident from below the decorative body. Therefore, compared to a case where light is incident only from above the decorative body, glitter of the decorative body is increased, and radiation directions of the light also spread out, so the decorative body can be made to beautifully glitter. Therefore, a product value of the watch to which the decorative body is attached can be improved, and quality can be increased.

The watch of the present disclosure may include a hand and a rotational movement shaft to which the hand is attached, and the inclined portion may include a first inclined portion having a first inclination angle with respect to an imaginary plane that has an axis of the rotational movement shaft as a normal line, and a second inclined portion having a second inclination angle and is connected with an outside of the first inclined portion.

Since the inclined portion includes the first inclined portion and the second inclined portion having the first and second inclination angles, respectively, light incident from various angles on a side of the watch case can be reflected and incident on the decorative body, glitter of the decorative body can be further increased, and the decorative body can be made to beautifully glitter.

In the watch of the present disclosure, in plan view when viewed from the cover glass side, a connection portion of the first inclined portion and the second inclined portion may be positioned outside a lower end portion of the decorative body.

Because the connection portion between the first inclined portion and the second inclined portion is positioned outside the lower end portion of the decorative body, light reflected by the first inclined portion is easily incident on the decorative body, and the decorative body can be made to beautifully glitter.

In the watch of the present disclosure, the decorative body may have a cut surface parallel to the first inclined portion.

Because the decorative body is provided with the cut surface parallel to the first inclined portion, light incident at various angles on and reflected by the first inclined portion easily enters the cut surface, and the decorative body can be made to more beautifully glitter.

In the watch of the present disclosure, the inclined portion may be formed in any of a V-shape, a U-shape, and a straight shape in side view of the watch case.

In side view of the watch case, by providing an inclined portion formed in any of a V-shape, a U-shape, or a straight shape, light reflected by the inclined portion can be incident on the decorative body at various angles, the way the decorative body glitters can be varied in each shape, and the way of glitter that is suitable for design of the watch can be selected.

What is claimed is:

1. A watch, comprising:

a watch case;

a cover glass attached to the watch case; and a decorative body attached to the watch case;

a hand; and a rotational movement shaft to which the hand is attached;

wherein the watch case includes;

a holding wall portion provided along an outer periphery of the cover glass, a first column portion provided outside the holding wall portion, a second column portion provided outside the holding wall portion, and provided at a distance from the first column portion, and an inclined portion including an inner end portion formed from between the first column portion and the second column portion to the holding wall portion, and is connected with the holding wall portion, and an outer end portion is connected with an outer surface of the watch case and provided at a position close to a rear surface of the watch case, the decorative body is held by the holding wall portion, the first column portion, and the second column portion, and the inclined portion includes a first inclined portion having a first inclination angle with respect to an imaginary plane having an axis of the rotational movement shaft as a normal line, and a second inclined portion having a second inclination angle with respect to the imaginary plane and is connected with an outside of the first inclined portion.

2. The watch according to claim 1, wherein in plan view when viewed from the cover glass side, a connection portion of the first inclined portion and the second inclined portion is positioned outside a lower end portion of the decorative body.

3. The watch according to claim 2, wherein the decorative body includes a cut surface parallel to the first inclined portion.

4. The watch according to claim 1, wherein the inclined portion is formed in any of a V-shape, a U-shape, and a straight shape in side view of the watch case.

* * * * *